US009041746B2

(12) United States Patent
Byun

(10) Patent No.: US 9,041,746 B2
(45) Date of Patent: May 26, 2015

(54) ORGANIC LIGHT EMITTING DIODE DISPLAY AND DRIVING METHOD THEREOF

(75) Inventor: Seungchan Byun, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 578 days.

(21) Appl. No.: 13/188,318

(22) Filed: Jul. 21, 2011

(65) Prior Publication Data

US 2012/0019569 A1 Jan. 26, 2012

(30) Foreign Application Priority Data

Jul. 22, 2010 (KR) ..... 10-2010-0070907

(51) Int. Cl.
*G09G 5/10* (2006.01)
*G09G 3/32* (2006.01)

(52) U.S. Cl.
CPC ..... *G09G 3/3233* (2013.01); *G09G 2320/0233* (2013.01); *G09G 2320/029* (2013.01); *G09G 2320/0626* (2013.01); *G09G 2330/02* (2013.01); *G09G 2330/04* (2013.01); *G09G 2360/16* (2013.01)

(58) Field of Classification Search
USPC ..... 345/82
See application file for complete search history.

(56) References Cited

U.S. PATENT DOCUMENTS

| | | | | |
|---|---|---|---|---|
| 2004/0032382 | A1* | 2/2004 | Cok et al. | 345/82 |
| 2008/0218448 | A1* | 9/2008 | Park et al. | 345/76 |
| 2008/0303754 | A1 | 12/2008 | Murata et al. | |
| 2010/0013824 | A1* | 1/2010 | Kim et al. | 345/214 |
| 2010/0188390 | A1* | 7/2010 | Min et al. | 345/212 |

FOREIGN PATENT DOCUMENTS

| | | | |
|---|---|---|---|
| CN | 101231816 | A | 7/2008 |
| JP | 2003-223140 | A | 8/2003 |

* cited by examiner

*Primary Examiner* — Dwayne Bost
*Assistant Examiner* — Robert Michaud
(74) *Attorney, Agent, or Firm* — Birch, Stewart, Kolasch & Birch, LLP

(57) ABSTRACT

A driving method of an OLED display device having a plurality of pixels each including an OLED which emits light in response to pixel data, includes applying black data to the pixels during a predetermined period directly after system power is applied, supplying driving voltages to the OLEDs during initial driving where the black data is applied to the pixels, detecting a driving current flowing through the OLEDs by the black data at a first non-emission period after at least one frame has elapsed from a time point where the driving voltages are supplied to the OLEDs, and applying pixel data to the pixels for normal driving subsequent to the initial driving.

7 Claims, 5 Drawing Sheets

ORGANIC LIGHT EMITTING DIODE DISPLAY AND DRIVING METHOD THEREOF

This application claims the benefit of Korean Patent Application No. 10-2010-0070907 filed on Jul. 22, 2010 in Republic of Korea, which is incorporated herein by reference for all purposes as if fully set forth herein.

BACKGROUND

1. Field

This document relates to an organic light emitting diode display device and a driving method thereof capable of preventing a luminance variation due to an external temperature or ambient light.

2. Related Art

Flat display devices include liquid crystal displays ("LCDs"), field emission displays ("FEDs"), plasma display panels ("PDPs"), electroluminescence devices, and the like.

The PDP has light weight and thin profile, and is advantageous to a large-sized screen because of simple structure and manufacturing process, but is disadvantageous in that luminous efficiency and brightness are low and power consumption is great. The TFT LCD (Thin Film Transistor LCD) is a widely used flat display device, but is disadvantageous in that a viewing angle is small and a response speed is low. The electroluminescence device is largely classified into an inorganic light emitting diode and an organic light emitting diode ("OLED") according to materials used for an emission layer, which is a light emitting device which emits light for itself, and is advantageous in that a response speed is high, and luminous efficiency, brightness and viewing angle are great.

The OLED display device, as shown in FIG. 1, includes an OLED. The OLED has an anode electrode, a cathode electrode, and organic compound layers.

The organic compound layers include a hole injection layer HIL, a hole transport layer HTL, an emission layer EML, an electron transport layer ETL, and an electron injection layer EIL. When driving voltages are applied to the anode electrode and the cathode electrode, and holes supplied via the hole injection layer HIL and the hole transport layer HTL and electrons supplied via the electron injection hole EIL and the electron transport layer ETL are moved to the emission layer to form the exciton, and in turn the emission layer EML emits light.

In the OLED display device, a plurality of pixels each including the OLED is arranged in a matrix, the pixels are selected by applying scan pluses to TFTs which are active elements, so as to be selectively turned on, and pixel data is supplied to the selected pixels, thereby controlling luminance for the pixels. Each of the pixels includes a driving TFT, at least one switching TFT, a storage capacitor, and the like, and the luminance for the pixel is proportional to a driving current Ioled flowing through the OLED as expressed in Equation 1.

$$Ioled = \frac{k}{2}(Vgs - Vth)^{2} \quad \text{Equation 1}$$

Here, 'Ioled' denotes a driving current, 'k' is a constant value defined by the mobility of the driving TFT and the parasitic capacitance, 'Vgs' denotes a gate-source voltage of the driving TFT, and 'Vth' denotes a threshold voltage of the driving TFT.

In the OLED display device, if the mobility of the driving TFT varies due to influence of an external temperature, or a photo current flows through the driving TFT due to influence of ambient light, the driving current Ioled flowing through the OLED varies. In a case where the driving current Ioled flowing through the OLED is greater than a value corresponding to the pixel data, the lifespan of the driving TFT and the OLED is shortened, and in a case where it is smaller than the value corresponding to the pixel data, a contrast ratio is lowered. Therefore, the present applicant has proposed a current feedback algorithm which enables an ideal driving current corresponding to pixel data to flow through an OLED by real-time feedback of a present driving current in Korean Patent Application No. 10-2009-0132960, which was filed. In this technique, a driving current is detected, and a high potential level is adjusted such that the detected driving current value is the same as a driving current value predicted from pixel data. Thereby, the technique prevents luminance from varying due to variations in external environmental conditions such as an external temperature or ambient light, by realizing ideal luminance corresponding to pixel data.

FIG. 2 shows a configuration of a current sensing circuit for detecting a driving current flowing through the OLED in the related art. Referring to FIG. 2, the current sensing circuit includes an operation amplifier 1 which converts the driving current Ioled flowing through the OLED into a voltage and amplifies the voltage, and an ADC (analog to digital converter) 2 which converts the amplified analog voltage value into a digital sensing current value Isen. In FIG. 2, 'Rs' indicates a sensing resistor connected between the driving voltage supply line 3 and the OLED.

However, in the OLED display device, the pixels emit light by being applied with driving voltages for driving the pixels during the initial driving, and thus a great number of currents may instantly flow through the driving voltage supply line 3. In this case, a voltage from the output terminal of the operational amplifier 1 may exceed an input voltage range of the ADC 2. In the related art, such an over-current may cause damage in the driving circuits and operation errors in the current feedback algorithm during the initial driving.

SUMMARY

Embodiments of this document provide an OLED display device and a driving method thereof capable of preventing damage in driving circuits and operation errors in a current feedback algorithm occurring during the initial driving, when the current feedback algorithm for preventing a luminance variation due to an external temperature or ambient light is applied.

According to an exemplary embodiment of this document, there is provided a driving method of an OLED (organic light emitting diode) display device having a plurality of pixels each including an OLED which emits light in response to pixel data, including applying black data to the pixels during a predetermined period directly after system power is applied; supplying driving voltages to the OLEDs in an initial driving process for applying the black data to the pixels; detecting a driving current flowing through the OLEDs by the black data at a first non-emission period after at least one frame has elapsed from a time point where the driving voltages are supplied to the OLEDs; and applying pixel data to the pixels for normal driving subsequent to the initial driving.

The predetermined period may be from before the driving voltage is applied to the OLEDs until the pixel data is output to the pixels.

The non-emission period may indicate a vertical blank period.

The step of detecting of the driving current may includes converting the driving current flowing through the OLEDs into a voltage and amplifying the voltage; and converting the amplified analog voltage value into a digital sensing current value.

The step of the normal driving may include calculating a digital estimation current value corresponding to the pixel data; detecting a digital sensing current value by sensing a driving current flowing through the OLEDs by the pixel data at a second non-emission period and thereafter, subsequent to the first non-emission period; and generating a digital luminance adjustment value such that the digital sensing current value is the same as the digital estimation current value through comparison of the digital estimation current value with the digital sensing current value, and adjusting a high potential gamma voltage source based on the digital luminance adjustment value.

According to another exemplary embodiment, there is provided an OLED display device including a display panel that is provided with a plurality of pixels each including an OLED which emits light in response to pixel data; a data driving circuit that drives data lines of the display panel; a timing controller that supplies black data to the data driving circuit during a predetermined period directly after system power is applied before the pixel data is supplied; a driving voltage supply circuit that supplies driving voltages to the OLEDs in an initial driving process for applying the black data to the pixels; and a luminance compensation circuit including a current sensing circuit that detects a driving current flowing through the OLEDs by the black data at a first non-emission period after at least one frame has elapsed from a time point where the driving voltage is supplied to the OLEDs, wherein the luminance compensation circuit prevents luminance for the display panel from varying due to variations in external environmental conditions.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Hereinafter, exemplary embodiments of this document will be described with reference to FIGS. 3 to 7.

Figure 1:
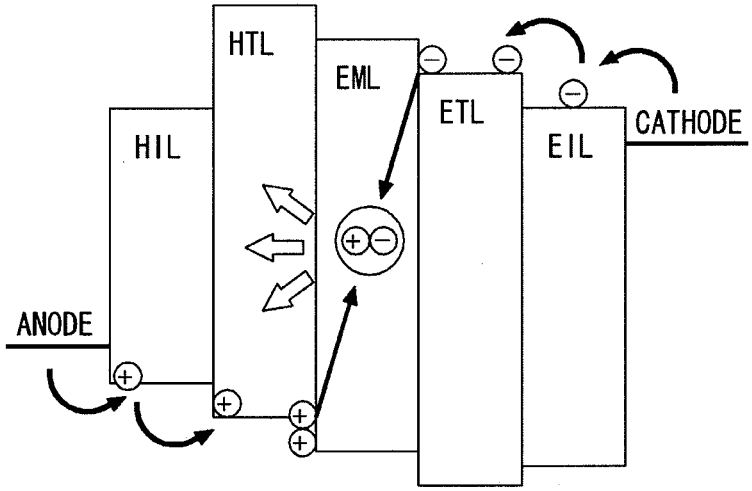
FIG. 1 (RELATED ART)
FIG. 1 is a diagram illustrating an emission principle in an OLED display device.
Figure 2:
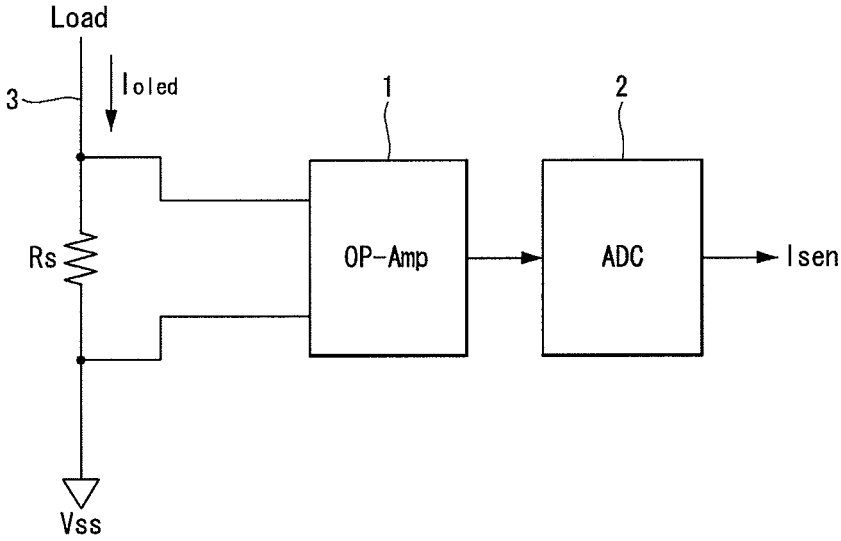
FIG. 2 (RELATED ART)
FIG. 2 is a diagram illustrating a current sensing circuit in the related art.
Figure 3:
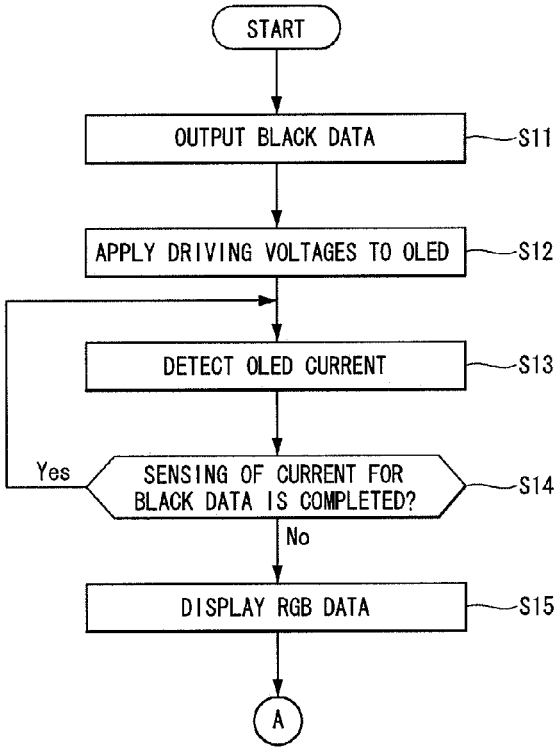
FIG. 3 is a diagram illustrating a driving method of the OLED display device during the initial driving according to an embodiment.
Figure 4:
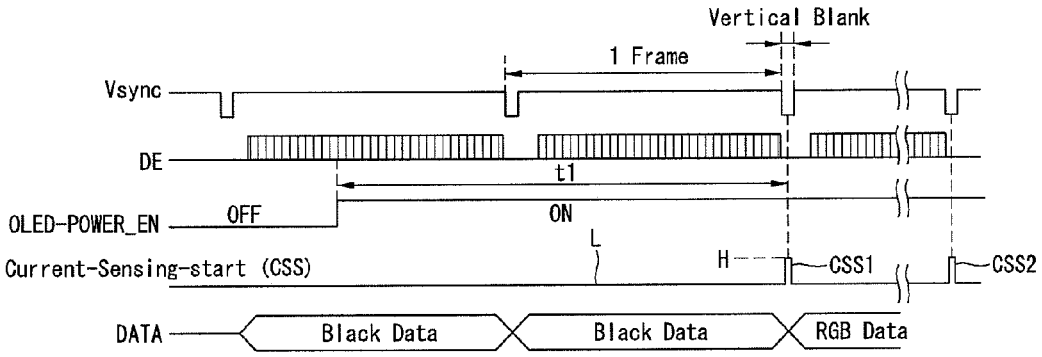
FIG. 4 is a diagram illustrating application timings of control signals and data during the initial timing and normal driving.
Figure 5:
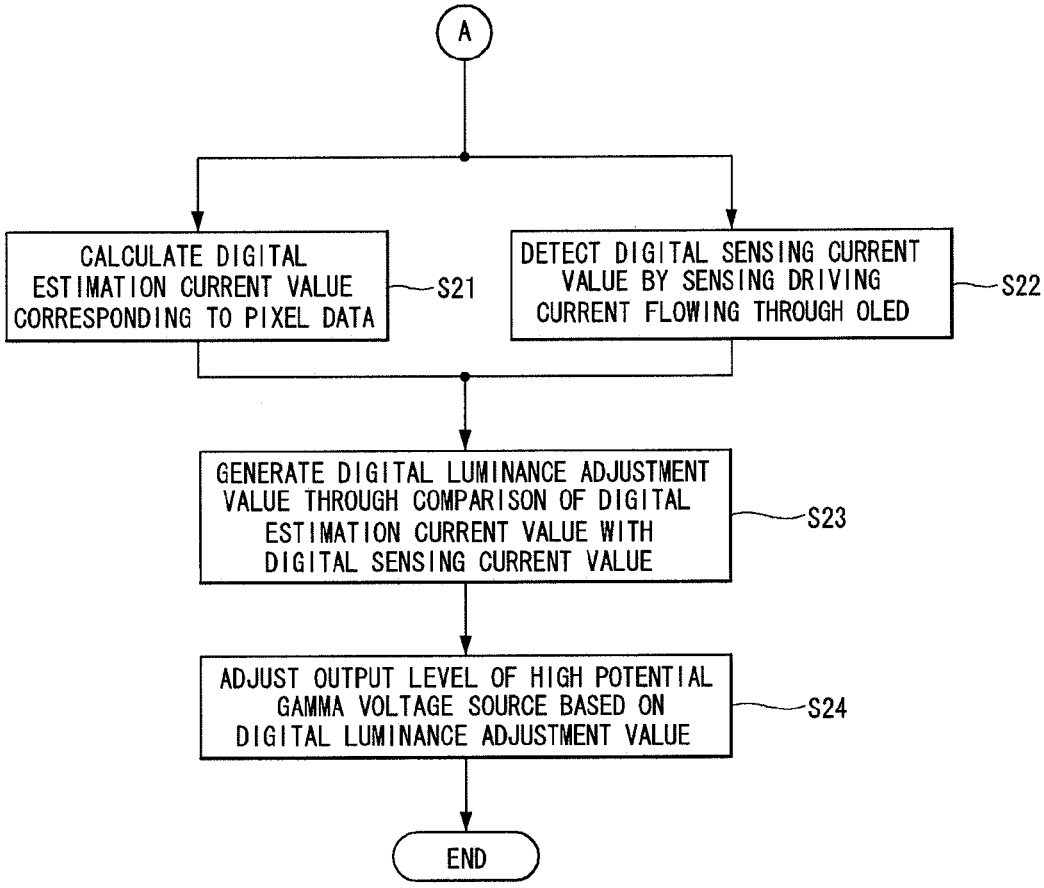
FIG. 5 is a diagram illustrating a driving method of the OLED display device during the normal driving according to an embodiment.

FIG. 3 shows a driving method of an OLED display device during the initial driving according to an embodiment of this document. FIG. 4 shows application timings of control signals and data during the initial driving and the normal driving. In addition, FIG. 5 shows a driving method of the OLED display device during the normal driving following the initial driving according to an embodiment of this document.

First, the initial driving according to the embodiment of this document will be described with reference to FIGS. 3 and 4. In the driving method of the OLED display device according to the embodiment of this document, directly after system power is applied to the display device, black data is output referring to a vertical synchronization signal Vsync and a data enable signal DE supplied from an external device (S11). The black data is output during a predetermined period from before driving voltages Vdd and Vss are applied to the OLEDs disposed in the pixels of a display panel until actual pixel data RGB is output. The black data is output from a timing controller, converted into data voltages in a data driving circuit, and then applied to the pixels.

In the driving method of the OLED display device, in the initial driving process for applying the black data to the pixels, a driving voltage enable signal OLED_POWER_EN enters an ON state such that the driving voltages Vdd and Vss are supplied to the OLEDs disposed in the pixels of the display panel (S12). Generally, a driving current flowing through the OLED is proportional to data voltage applied to the pixel. In other words, as the data voltage becomes greater according to a bright image, the driving current at the OLED is heightened, and as the data voltage becomes smaller according to a dark image, the driving current is lowered. Therefore, in a case where the black data is applied in order to realize a black image, the OLED driving current is 0 A in theory, and, at this time, a current sensing circuit has the lowest output value. The ON state of the driving voltage enable signal OLED_POWER_EN is maintained until the system power is turned off.

Figure 7:
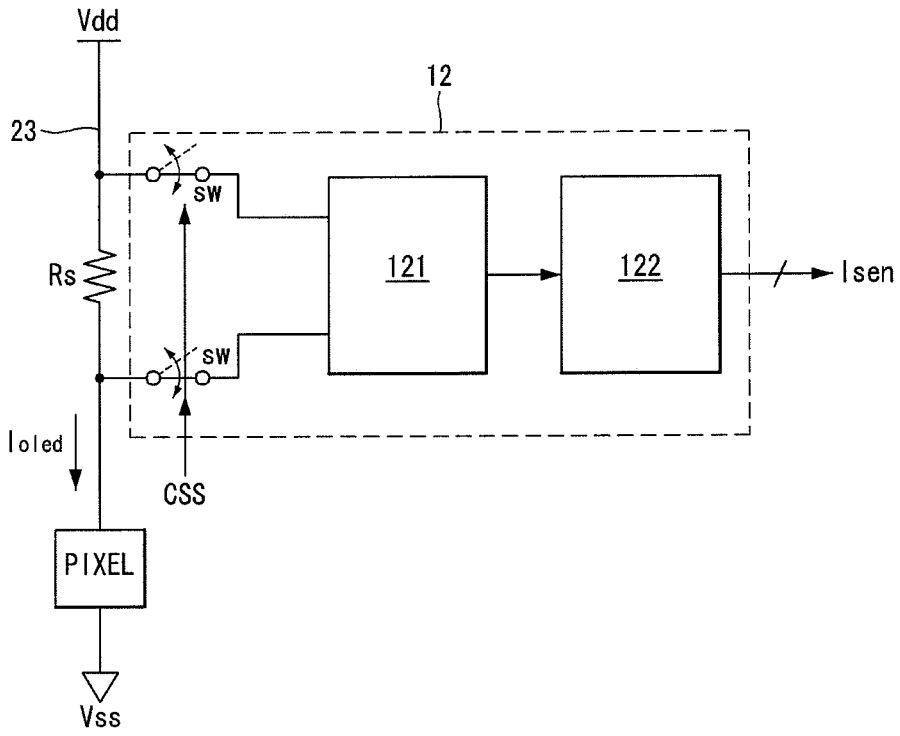
FIG. 7 is a detailed diagram illustrating a current sensing circuit shown in FIG. 6.

In the driving method of the OLED display device, a current sensing circuit 12 including an operational amplifier 121 and an ADC 122, as shown in FIG. 7, detects a driving current flowing through the OLEDs during a non-emission period (for example, a vertical blank period) after at least one frame period t1 has elapsed from a time point when the driving voltages Vdd and Vss are supplied to the OLED (S13). The current sensing circuit 12 is operated in response to a current sensing start signal CSS. The current sensing start signal CSS has a high logic level for each vertical blank period beginning from the vertical blank period after at least one frame period t1 has elapsed from a time point when the driving voltages Vdd and Vss are supplied to the OLEDs. The current sensing circuit 12 detects an OLED driving current for the black data in response to the high logic level of the first current sensing start signal CSS1. The OLED driving current for the black data has 0 A or a value similar thereto, and thus an output value from the operational amplifier 121 is 0 V or the lowest voltage value in an input voltage range of the ADC 122. In the driving method of the OLED display device, through the process in step S13, it is possible to prevent damage in the driving circuits and operation errors in the current feedback algorithm during the initial driving, by blocking the output terminal voltage of the operational amplifier 121 from exceeding the input voltage range of the ADC 122.

In the driving method of the OLED display device, if the sensing of the OLED driving current corresponding to the black data is completed (S14), actual pixel data RGB is output (S15). The actual pixel data RGB is output from the timing controller, converted into data voltages in the data driving circuit, and then is applied to the pixels. During the normal driving, following the initial driving, where the actual pixel data RGB is displayed, since a driving current flowing through the OLEDs is limited by the pixel data RGB, there is no concern that the driving circuits may be damaged and operation errors may occur in the current feedback algorithm due to over-currents in the current sensing circuit 12.

A method for preventing a luminance variation due to an external temperature or ambient light during the normal driving according to an embodiment of this document will be described with reference to FIG. 5.

First, in the driving method of the OLED display device, a digital estimation current value corresponding to pixel data RGB is calculated (S21). In addition, a digital sensing current value is detected by sensing an OLED driving current for actual pixel data RGB in response to the high logic level of the second current sensing start signal CSS2 and thereafter (S22).

Next, the digital estimation current value is compared with the digital sensing current value, and then a digital luminance adjustment value is generated such that the digital sensing current value is the same as the digital estimation current value (S23). Thereafter, the digital luminance adjustment value is digital-analog converted, and an output level of a high potential gamma voltage source is adjusted based on the analog luminance adjustment value (S24). Thereby, in the driving method of the OLED display device, by realizing ideal luminance corresponding to the pixel data RGB, it is possible to prevent luminance from varying due to the external environmental conditions such as an external terminal or ambient light.

Figure 6:
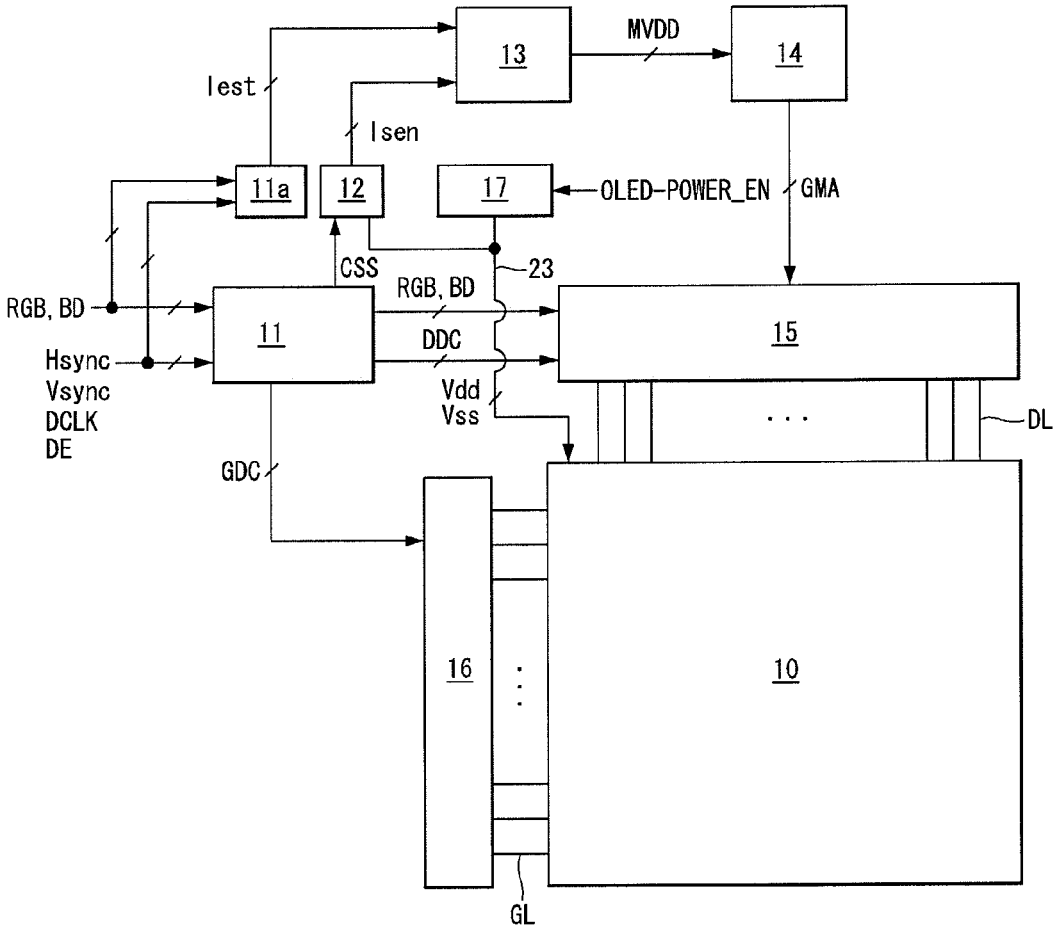
FIG. 6 is a diagram illustrating the OLED display device according to the embodiment.

FIG. 6 shows the OLED display device according to the embodiment of this document. FIG. 7 shows in detail the current sensing circuit 12 shown in FIG. 6.

In FIG. 6, the OLED display device according to the embodiment of this document includes a display panel 10, a timing controller 11, a current estimation circuit 11*a*, a current sensing circuit 12, a gamma voltage adjustment circuit 13, a gamma reference voltage generation circuit 14, a data driving circuit 15, a gate driving circuit 16, and a driving voltage supply circuit 17. Here, the current estimation circuit 11*a*, the current sensing circuit 12, and the gamma voltage adjustment circuit 13 function as a luminance compensation circuit for prevention luminance from varying due to external environmental conditions (temperature, ambient light).

The display panel 10 is provided with a plurality of data lines DL and a plurality of gate lines GL intersecting each other, and pixels arranged in a matrix at the intersections. The pixels include red pixels having red OLEDs, green pixels having green OLEDs, and blue pixels having blue OLEDs. Each of the pixels includes a driving TFT, at least one switching TFT, a storage capacitor, and the like, and may be implemented by any well-known structure. Each of the pixels is connected to the data line DL and the gate line GL via the switching TFT, and is supplied with a data voltage from the data driving circuit 15 and a scan pulse from the gate driving circuit 16. Further, each of the pixels is connected to a driving voltage supply line 23, and is supplied with a high potential driving voltage Vdd and a low potential driving voltage Vss from the driving voltage supply circuit 17. The driving voltage supply line 23 may be disposed independently for the respective red, green, and blue pixels, or may be disposed to be common to the red, green, and blue pixels.

The timing controller 11 rearranges digital pixel data RGB input from an external device to be suitable for the resolution of the display panel 10, and supplies the pixel data RGB to the data driving circuit 15. The timing controller 11 supplies black data BD to the data driving circuit 15 before supplying to the digital pixel data RGB. The black data BD is supplied to the data driving circuit 15 during a predetermined period from before the driving voltages Vdd and Vss are applied to the OLEDs disposed in the pixels of the display panel 10 until the digital pixel data RGB is supplied.

The timing controller 11 generates a data control signal DDC for controlling operation timings of the data driving circuit 15, a gate control signal GDC for controlling operation timings of the gate driving circuit 16, and a current sensing start signal CSS for controlling operation timings of the current sensing circuit 12, based on timing signals such as a horizontal synchronization signal Hsync, a dot clock signal DCLK, and a data enable signal DE.

The current estimation circuit 11*a* calculates a digital estimation current value lest flowing through the pixels for each frame with respect to the digital pixel data RGB of one frame. For this, the current estimation circuit 11*a* includes a lookup table which stores driving current values predefined for gray-scale values of pixel data and outputs a corresponding driving current value each time pixel data RGB is input, and an adder which calculates a digital estimation current value by accumulating the driving current values output from the lookup table during one frame.

The current sensing circuit 12 digital-analog converts a driving current Ioled flowing through the OLEDs via the driving voltage supply line 23 in response to the current sensing start signal CSS from the timing controller 11, thereby detecting a digital sensing current value Isen. The current sensing circuit 12 includes the operational amplifier 121 which converts the driving current Ioled flowing through the OLEDs into a voltage and the amplifies the voltage, the ADC 122 which converts the amplified analog voltage value into a digital sensing current value Isen, and switching elements SW which switch electrical connections between both ends of a sensing resistor Rs and the operational amplifier 121 in response to the current sensing start signal CSS.

The current sensing circuit 12 is operated in response to the current sensing start signal CSS. The current sensing start signal CSS has a high logic level for each vertical blank period beginning from the vertical blank period after at least one frame period t1 has elapsed from a time point when the driving voltages Vdd and Vss are supplied to the OLEDs. During the initial driving, the current sensing circuit 12 detects an OLED driving current for the black data in response to the high logic level of the first current sensing start signal CSS1. The OLED driving current for the black data has 0 A or a value similar thereto, and thus an output value from the operational amplifier 121 is 0 V or the lowest voltage value in an input voltage range of the ADC 122. Thereby, it is possible to prevent damage in the driving circuits and operation errors in the current feedback algorithm during the initial driving, by blocking the output terminal voltage of the operational amplifier 121 from exceeding the input voltage range of the ADC 122.

During the normal driving, following the initial driving, where the actual pixel data RGB is displayed, the current sensing circuit 12 detects the digital sensing current value Isen by sensing an OLED driving current for the actual pixel data RGB in response to the high logic level of the second current sensing start signal CSS2 and thereafter. During such normal driving, since a driving current flowing through the OLEDs is limited by the pixel data RGB, there is no concern that the driving circuits may be damaged and operation errors may occur in the current feedback algorithm due to over-currents in the current sensing circuit 12.

The gamma voltage adjustment circuit 13 compares the digital estimation current value lest with the digital sensing current value Isen, and then generates a digital luminance adjustment value such that the digital sensing current value is the same as the digital estimation current value. Thereafter, the gamma voltage adjustment circuit 13 performs digital-analog conversion for the digital luminance adjustment value so as to output an analog luminance adjustment value, and adjusts an output level of a high potential gamma voltage source MVDD based on the analog luminance adjustment value. Thereby, luminance for a display image is realized as ideal luminance regardless of the external environmental conditions (external terminal or ambient light).

The gamma reference voltage generation circuit 14 includes a plurality of resistor strings connected between the high potential gamma voltage source MVDD and the ground voltage, and generates a plurality of gamma reference voltages GMA obtained by voltage division between the high voltage and the ground voltage. The gamma reference voltages GMA can be also easily adjusted to a desired level by adjusting a level of the high potential gamma voltage source MVDD.

The data driving circuit 15 converts the black data BD and the digital pixel data RGB into gamma compensation voltages by referring to the gamma reference voltages GMA in response to the control control signal DDC from the timing controller 11, and supplies the gamma compensation voltages to the data lines DL of the display panel 10 as data voltages.

The gate driving circuit 16 generates a scan pulse changing between a gate high voltage for turning on the switching TFT of the pixel and a gate low voltage for turning off the switching TFT in response to the gate control signal GDC from the timing controller 11. In addition, the scan pulse is sequentially supplied to the gate lines GL so as to sequentially drive the gate lines GL, thereby selecting horizontal lines of the display panel 10 to which the data voltages are supplied.

The driving voltage supply circuit 17 generates the high driving voltage Vdd and the low driving voltage Vss in response to the driving voltage enable signal OLED_POWER_ON supplied from an external device, and supplies the high driving voltage Vdd and the low driving voltage Vss to the pixels via the driving voltage supply line 23. The driving voltage enable signal OLED_POWER_ON enters an ON state in the initial driving process where the black data BD is applied to the pixels, as shown in FIG. 4. The ON state of the driving voltage enable signal OLED_POWER_ON is maintained until the system power is turned off.

As described above, according to the OLED display device and the driving method thereof of this document, when the current feedback algorithm for preventing a luminance variation due to an external temperature or ambient light is applied, it is possible to prevent damage in driving circuits and operation errors in the current feedback algorithm in advance by applying black data to the pixels during a predetermined period from before driving voltages are applied to the OLEDs until actual pixel data is applied thereto so as to block an output terminal voltage of the operational amplifier from exceeding an input voltage range of the ADC.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A driving method of an OLED (organic light emitting diode) display device having a plurality of pixels each including an OLED which emits light in response to pixel data, comprising:

applying black data to the pixels during a predetermined period directly after system power is applied;

supplying driving voltages to the OLEDs in an initial driving process for applying the black data to the pixels;

detecting a driving current flowing through the OLEDs by the black data at a first non-emission period after at least one frame has elapsed from a time point where the driving voltages are supplied to the OLEDs; and applying pixel data to the pixels for normal driving subsequent to the initial driving process, wherein only the black data is applied to the pixels during the predetermined period, wherein the predetermined period for the initial driving process is from before the driving voltage is applied to the OLEDs until the pixel data is output to the pixels for the normal driving, wherein the first non-emission period indicates a vertical blank period, and wherein a data enable signal is maintained at a low logic level in the vertical blank period so that the pixel data and the black data are not written to the pixels.

2. The driving method of the OLED display device of claim 1, wherein the step of detecting of the driving current includes:

converting the driving current flowing through the OLEDs into a voltage and amplifying the voltage; and converting the amplified analog voltage value into a digital sensing current value.

3. The driving method of the OLED display device of claim 1, wherein the step of the normal driving includes:

calculating a digital estimation current value corresponding to the pixel data;

detecting a digital sensing current value by sensing a driving current flowing through the OLEDs by the pixel data at a second non-emission period and thereafter, subsequent to the first non-emission period; and generating a digital luminance adjustment value such that the digital sensing current value is the same as the digital estimation current value through comparison of the digital estimation current value with the digital sensing current value, and adjusting a high potential gamma voltage source based on the digital luminance adjustment value.

4. An OLED display device comprising:

a display panel that is provided with a plurality of pixels each including an OLED which emits light in response to pixel data;

a data driving circuit that drives data lines of the display panel;

a timing controller that supplies black data to the data driving circuit during a predetermined period directly after system power is applied before the pixel data is supplied;

a driving voltage supply circuit that supplies driving voltages to the OLEDs in an initial driving process for applying the black data to the pixels; and a luminance compensation circuit including a current sensing circuit that detects a driving current flowing through the OLEDs by the black data at a first non-emission period after at least one frame has elapsed from a time point where the driving voltage is supplied to the OLEDs, wherein the luminance compensation circuit prevents luminance for the display panel from varying due to variations in external environmental conditions, wherein only the black data is applied to the pixels during the predetermined period, wherein the predetermined period for the initial driving process is from before the driving voltage is applied to the OLEDs until the pixel data is output to the pixels for the normal driving, wherein the first non-emission period indicates a vertical blank period, and wherein a data enable signal is maintained at a low logic level in the vertical blank period so that the pixel data and the black data are not written to the pixels.

5. The OLED display device of claim 4, wherein the current sensing circuit includes:

an operational amplifier that converts a driving current flowing through the OLEDs into a voltage and amplifies the voltage;

an ADC(analog to digital converter) that converts the amplified analog voltage value into a digital sensing current value; and switching elements that switch electrical connections between both ends of a sensing resistor of a driving voltage supply line connected to the OLEDs and the operational amplifier in response to a current sensing start signal, wherein the current sensing start signal has a high logic level for each vertical blank period beginning from the vertical blank period after at least one frame period has elapsed from a time point when driving voltages are supplied to the OLEDs.

6. The OLED display device of claim 5, wherein the current sensing circuit detects a digital sensing current value by sensing a driving current flowing through the OLEDs by the pixel data at a second vertical blank period and thereafter, subsequent to the first vertical blank period.

7. The OLED display device of claim 6, wherein the luminance compensation circuit further includes:

a current estimation circuit that calculates a digital estimation current value corresponding to the pixel data; and a gamma voltage adjustment circuit that generates a digital luminance adjustment value such that the digital sensing current value is the same as the digital estimation current value through comparison of the digital estimation current value with the digital sensing current value, and adjusts a high potential gamma voltage source based on the digital luminance adjustment value.

* * * * *